US011130603B1

(12) United States Patent
Lichtenberg

(10) Patent No.: US 11,130,603 B1
(45) Date of Patent: Sep. 28, 2021

(54) METHOD AND APPARATUS FOR REMOVING UNATTACHED LABELS FROM A LABEL APPLICATOR SYSTEM

(71) Applicant: Hurst International, LLC, Chatsworth, CA (US)

(72) Inventor: Ari Lichtenberg, Chatsworth, CA (US)

(73) Assignee: HURST INTERNATIONAL, LLC, Chatsworth, CA (US)

( * ) Notice: Subject to any disclaimer, the term of this patent is extended or adjusted under 35 U.S.C. 154(b) by 0 days.

(21) Appl. No.: 16/925,702

(22) Filed: Jul. 10, 2020

(51) Int. Cl.

| | |
|---|---|
| ***B65C 9/30*** | (2006.01) |
| ***B65C 9/40*** | (2006.01) |
| ***B65C 9/36*** | (2006.01) |
| ***B65C 9/18*** | (2006.01) |

(52) U.S. Cl.
CPC ..... *B65C 9/30* (2013.01); *B65C 9/188* (2013.01); *B65C 9/1815* (2013.01); *B65C 9/1819* (2013.01); *B65C 9/36* (2013.01); *B65C 2009/407* (2013.01); *Y10T 156/1771* (2015.01)

(58) Field of Classification Search
CPC ..... B65C 9/26; B65C 9/36; B65C 9/1815; B65C 9/1819; B65C 9/176; B65C 9/188; B65C 2009/402; B65C 2009/404; B65C 2009/407; Y10T 156/1768; Y10T 156/1771
See application file for complete search history.

(56) References Cited

U.S. PATENT DOCUMENTS

| | | | | |
|---|---|---|---|---|
| 5,405,482 | A * | 4/1995 | Morrissette | B65C 9/188 156/362 |
| 6,841,018 | B2 * | 1/2005 | Pituch | B65C 9/188 156/249 |
| 2012/0211173 | A1 * | 8/2012 | Fefin | B65C 9/1865 156/714 |

* cited by examiner

*Primary Examiner* — Carson Gross
(74) *Attorney, Agent, or Firm* — Tutunjian & Bitetto, P.C.

(57) ABSTRACT

A device for removing labels from a label applicator in a produce labeling system is provided. The device includes a label pickup roller positioned in the downstream path of the label applicator. A spindle is positioned on the machine such that the label pickup roller can be positioned as described. When a label attempted to be applied to produce from the label applicator does not get applied for any reason, the pickup roller removes this unapplied label from the label applicator before the label applicator travels back to the label dispenser to receive another label for the next labeling cycle.

11 Claims, 9 Drawing Sheets

METHOD AND APPARATUS FOR REMOVING UNATTACHED LABELS FROM A LABEL APPLICATOR SYSTEM

BACKGROUND

Technical Field

The present invention relates to produce label applicator systems. More particularly, it relates to a method and device for removing unattached labels from a produce label applicator system.

Description of the Prior Art

Label applicator systems are used for many different label printing operations. In the food industry, for example, label applicator systems are used to label produce with removable barcodes. Similarly, manufacturing industries make use of label applicator systems to label each product. In these commercial settings, the label applicator systems operate at high speeds. Consequently, if the object being labeled is misaligned, missing or simply does not provide a surface to which the label can properly adhere, the label can remain on the label applicator. In such a situation the label may adhere to internal components of the label applicator systems or be applied, along with a second label to a subsequent object. Both outcomes are undesirable.

SUMMARY

According to an embodiment, a device for removing unattached labels from a label applicator system includes a spindle mounted to a side of the label applicator system proximate to a rotational path of a label applicator; and a label pickup roller encircling a long axis of the spindle, the spindle extending along a rotational axis of the label pickup roller. The label pickup roller is positioned to contact the label applicator at a point along the rotational path of the label applicator. The label pickup roller is configured to remove labels that failed to adhere to an object to be labeled from the label applicator.

In another embodiment, a label pickup roller assembly is provided. The label pickup roller includes a label pickup roller formed of a foam material and having a cylindrical shape. A spindle is inserted through a through hole formed along a rotational axis of the label pickup roller. A first E-style retainer ring is engaged with the spindle at a first side of the label pickup roller; and a second E-style retainer ring is engaged with the spindle at a second side opposite the first side of the label pickup roller. A collar is configured to attach to a surface of a label applicator system. The collar includes a central bore configured to accept insertion of the spindle. A spring plunger is disposed on the collar and configured to engage with a recess region formed on the spindle.

Other aspects and features of the present principles will become apparent from the following detailed description considered in conjunction with the accompanying drawings. It is to be understood, however, that the drawings are designed solely for purposes of illustration and not as a definition of the limits of the present principles, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings wherein like reference numerals denote similar components throughout the views.

DETAILED DESCRIPTION

Figure 1A:
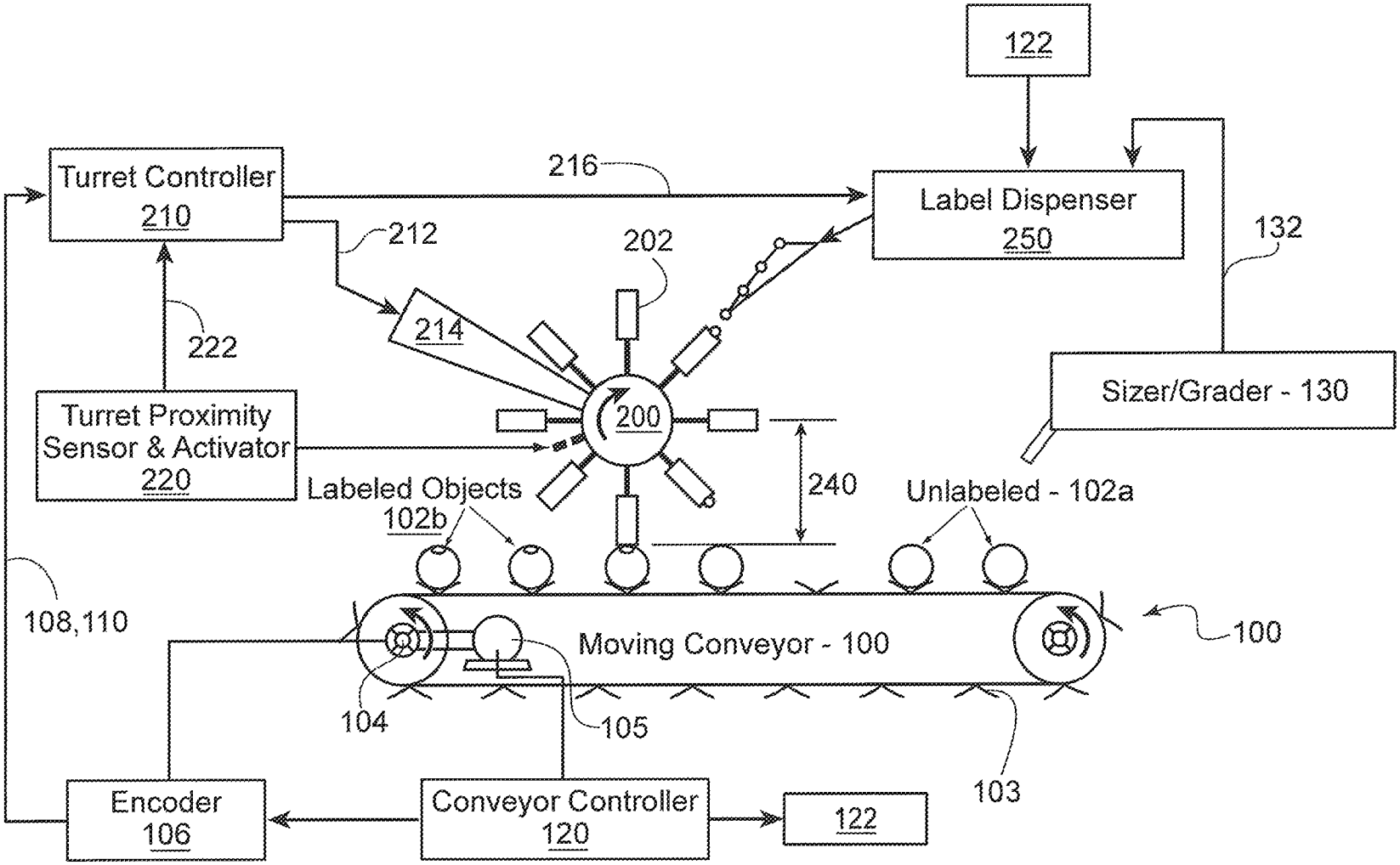
FIG. 1A is a schematic view of components of a high-speed label applicator system according to an embodiment the invention.
Figure 1B:
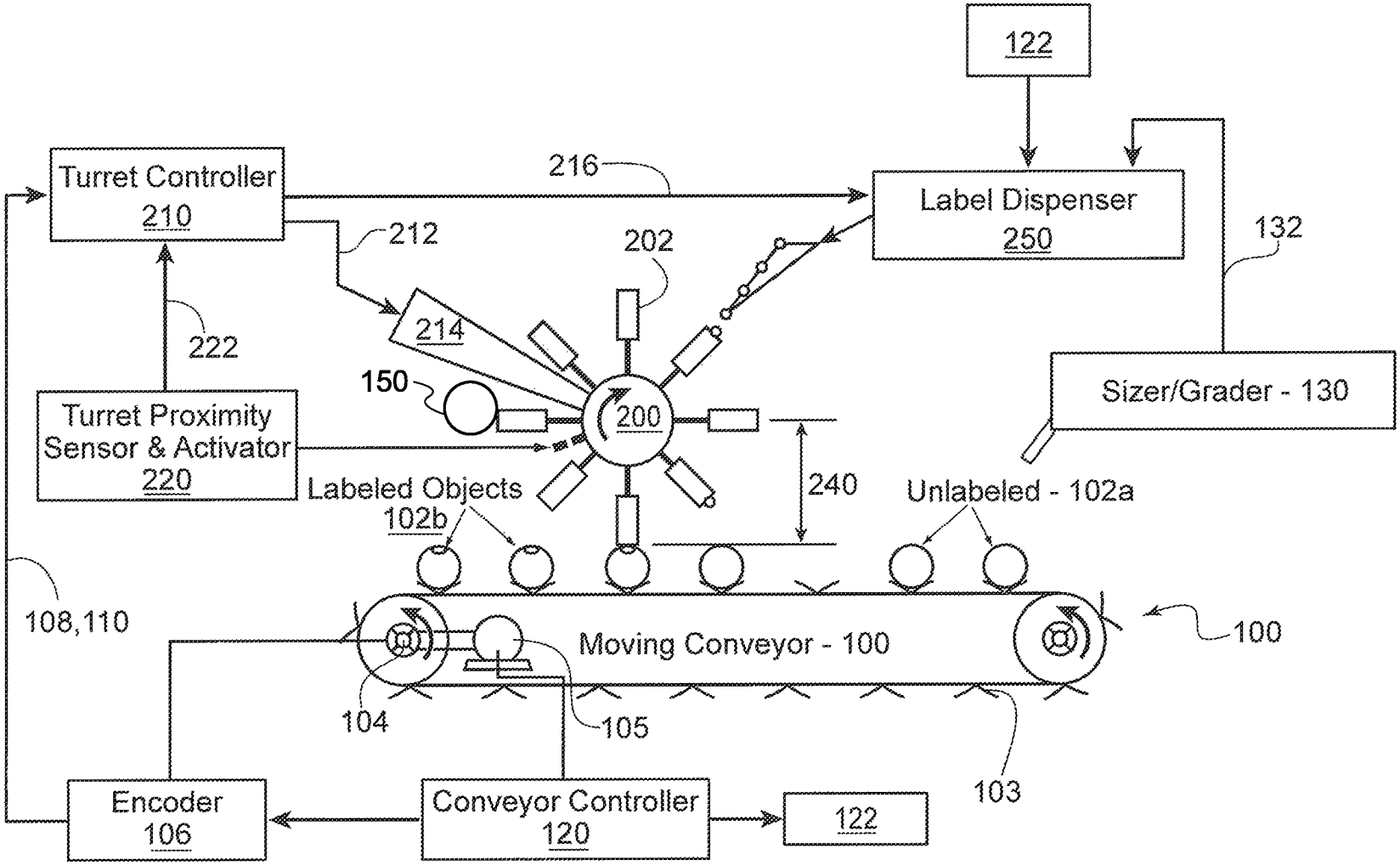
FIG. 1B is a schematic view of components of a high-speed label applicator system according to an embodiment of the invention.
Figure 2:
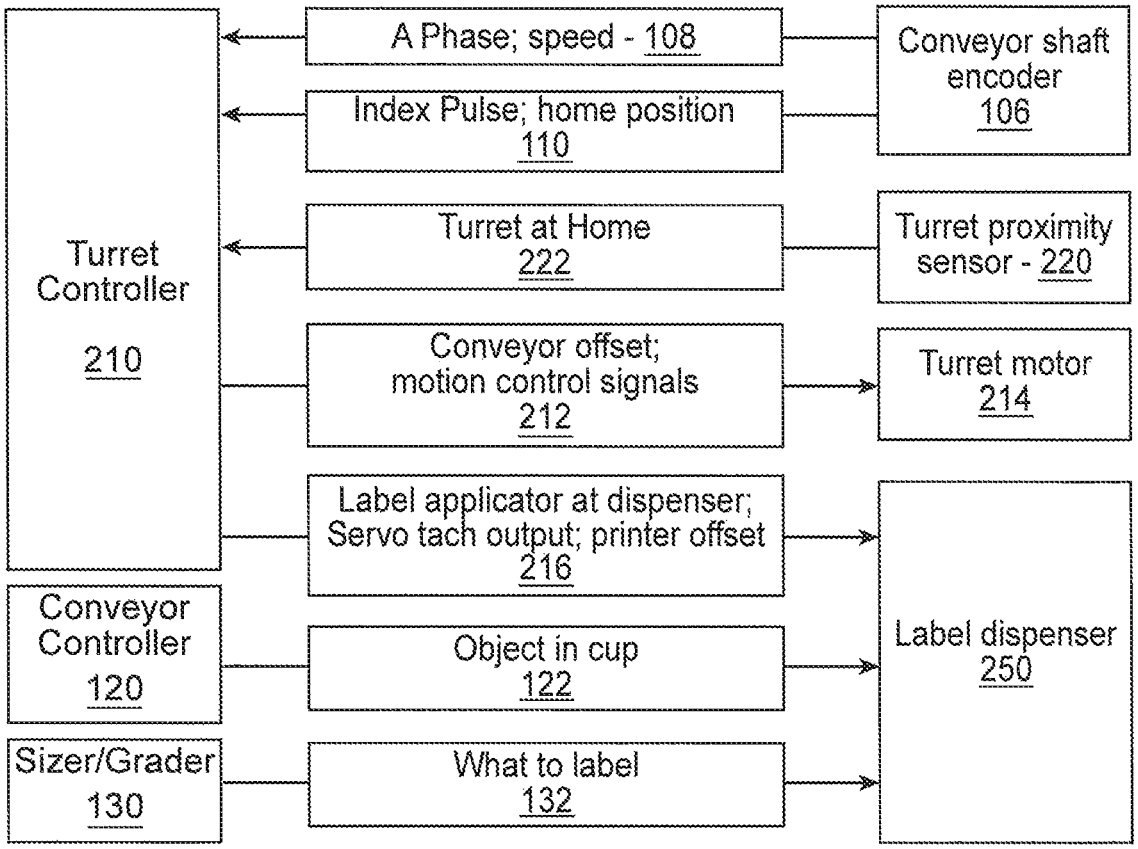
FIG. 2 is a block diagram of signals and paths according to an embodiment of the invention.

An overview of the system components, related controllers and signal paths for produce labeling are provided with reference to FIGS. 1A, 1B and 2.

A rotating turret 200 is suspended above a moving conveyor 100. The turret 200 includes label depositor arms 202 which pick-up printed labels from label dispenser 250 and adheres the labels on to objects, such as produce, for example, passing below on conveyor 100. A turret controller 210 receives signals from various sensors to control the speed and rotational position of the turret 200. The conveyor 100 is illustrated as a single lane. In practical applications, the conveyor 100 can be many feet wide and encompass multiple lanes each having a turret 200 suspended above it. Accordingly, the controller 210 may be configured to operate multiple turrets 200, i.e. one per lane. Alternatively, a master controller may be provided along with multiple slave controllers, each of which controls a single turret 200.

The turret 200 turns in a radial motion from its center and is aligned to accept labels from the label dispenser 250 and deposit them onto the unlabeled objects 102*a* moving along the conveyor 100. The turret 200 can be configured to move synchronously with the conveyor 100 so that the speed of a fully extended label depositor arm 202, at radius 240, where the label is applied, matches 1 to 1 with the linear speed of the conveyor 100 and therefore the items being carried thereon.

Each label depositor arm 202 is a flexible device designed to accept a label from the label dispenser 250 and apply it to an object 102*a* through contact. One turret 200 can have a number of label applicators spaced evenly on the turret. label depositor arms 202 are also referred to as label applicators.

The label dispenser 250 holds a reel of on-demand printable labels and ejects the labels at a location close to where the label depositor arms 202 pass so that the labels can be picked up, via suction, by the label depositor arm 202 as it spins past the label dispenser 250.

The conveyor 100 is a moving belt or chain link device that moves items to be labeled in a linear motion under the turret 200 and the label depositor arms 202. Items on the conveyor 100 are confined to specific locations called cups 103, which are spaced, at consistent intervals along the conveyor 100.

The conveyor controller 120 controls the movement of the conveyor 100 and employs sensors (not shown) to determine presence of objects in the cups 103. The conveyor controller 120 generates an Object-In-Cup signal 122 to indicate if an object is present in a cup 103 at a specific location. When an Object-In-Cup signal 122 is present, a produce sizer and grader scanner 130 can provide size and grade data, in the form of a size and grade signal 132, to determine the type of label that is needed.

The conveyor controller 120 can operate a conveyor motor 105 coupled to a conveyor shaft 104 which rotates to cause the conveyor 100 to advance. The shaft 104 can be configured in such a way that an exact whole number of conveyor cups 103 are advanced per one revolution. In some embodiments, a single motor 105 and shaft 104 can be utilized to drive all lanes of the conveyor 100. From a motive perspective, all lanes comprise one large conveyor 100. However, if the lanes utilize carrier chains, variations from chain to chain can occur.

A turret proximity sensor 220 can be a position sensor having two parts; a sensor mounted in a stationary position and an activator (such as a metal pin) mounted to the moving turret 200. The turret proximity sensor 220 is used to determine the home position of the turret 200.

In certain situations, labels may not properly adhere to the object 102*a* being labeled. When labels do not adhere to the object, the label can remain on the label applicator 202 as the label applicator 202 rotates back to the label dispenser 250. When the label travels back to the label dispenser 250, a second label is then attempted to be placed on top of the first label resulting in multiple labels being placed on a subsequent object 102*a*. It will be apparent that if a stray or unapplied label remains on the label applicator 202 by the time the same returns to the label dispenser to pickup the next label, the next label cannot properly adhere to the label applicator because the stray/unapplied label will interfere with the vacuum suction used to hold the label to the label applicator 202.

Accordingly as shown in FIG. 1B, a label pickup roller 150 can be positioned in the rotation path of the label applicator 202 at a point downstream or after the label applicator 202 would have otherwise applied a label to an object 102*a*. The label pickup roller 150, as described in greater detail below, is generally cylindrical in shape with a uniform outer surface and is positioned so as to be in the path of an contact the label applicator 202 and thereby provide a uniformly even surface to which an unapplied label (remaining on the label applicator) can and will adhere. In this way, unapplied labels are prevented from traveling beyond a designated point along the path of the label applicator 202, and more preferably before the label applicator 202 returns to the label dispenser 250 to pick up another label for subsequent application.

The turret controller 210 is a programmable device that can be used to process input signals, generate output signals and to the control turret motor 214. A description of the signals and signal paths used in applicant's system can be seen in FIG. 2, and are described as follows.

The conveyor encoder 106 can be a radial encoder placed on the conveyor shaft 104. In some embodiments, the conveyor shaft encoder 106 generates two signals an A Phase signal 108 and an Index Pulse 110, which are used to control the motion of the turret 200. First, an A Phase signal 108 indicates conveyor motion by evenly pulsing a specified number of times, typically 1000 per revolution of the conveyor shaft 104. The A Phase Signal 108 is used by turret controller 210 to synchronize the speed of a turret motor 214 to the conveyor speed. Second, an Index Pulse 110 indicates that the conveyor shaft 104 is at its home position by pulsing at an exact shaft position once per revolution. The Index Pulse 110 is used to indicate where the cups 103 are in relation to the conveyor shaft 104. The Index Pulse 110 is used by the turret controller 210, as will be described in greater detail below.

A Turret-At-Home signal 222 indicates that the turret 200 is at position where the stationary the turret proximity sensor 220 is lined up with the sensor activator mounted on the turret 200. The Turret-at-Home signal 222 generated by the turret proximity sensor and is used by the turret controller 210.

Motion control signals 212 are generated by the turret controller 210 to move the turret motor 214 for homing and label application.

A Label-Applicator-At-Dispenser signal 216 indicates that the label applicator 202 is in position to receive a label from the label dispenser 250. The pulse rate per turret revolution is equal to the number of label applicators 202 on the turret 200. The Label-Applicator-At-Dispenser signal 216 is used by the label dispenser 250 in conjunction with the Object-In-Cup signal 122 to dispense a label with correct timing for the label applicator 202 to pick up the label. The Label-Applicator-At-Dispenser signal 216 is generated by the turret controller 210 and used by the label dispenser 250. The Label-Applicator-At-Dispenser signal 216 can also be functionally described as a servo tach output, and is utilized in a printer offset function.

An Object-in-Cup signal 122 indicates an object 102*a* is in a cup 103 that will eventually contact a label depositor arm 202. The Object-in-Cup signal 122 is used by label dispenser 250 in conjunction with the Label-Applicator-At-Dispenser signal 216 to dispense a label with correct timing for the label depositor arm 202 to pick up the label. The Object-in-Cup signal 122 is generated by conveyor controller 120 and is used by the label dispenser 250.

A produce sizer and grader scanner 130 is positioned above the conveyor 100. The scanner 130 utilizes object recognition software to generate a size and grade signal 132 which is transmitted to the label dispenser 250. In some embodiments, the label dispenser 250 can use the data embodied in the size and grade signal 132 to direct a search through a look-up table to retrieve the appropriate label graphics.

To accommodate high speed operation the label dispenser 250 needs to accurately know when the label applicator 202 is in position to accept a label. To accomplish this the position of the turret 200 is determined by the turret controller 210. This is done by "homing" the turret 200. Homing is done by spinning the turret 200 until the turret proximity sensor 220 is lined up with the sensor's activator which activates the Turret-At-Home signal 222. Because the turret proximity sensor 220 is attached to a fixed location on the system's frame and the activator is on the turret 200, this signal is generated when the turret 200 is in a specific "Home" location.

To increase the accuracy of this process the turret 200 can be spun at normal speed until the Turret-At-Home signal 222 is detected. Then the turret 200 is backed up a short distance and then rotated forward again at a much slower rate which increases the accuracy by increasing the number of times the turret controller 210 can check for the Turret-At-Home signal 222 per unit of rotation. When the Turret-At-Home signal 222 is detected the turret 200 is stopped and is considered "Homed".

Once the turret 200 is in the Home location the turret controller 210 can generate the Label-Applicator-At-Dispenser signal 216 as the turret 200 spins in a way that is consistent in relation to the position of the label applicators 202. The turret controller 210 can also offset this signal from the home position to account for differences in the physical locations of the turret proximity sensor 220 relative to the label dispenser 250 due to design or manufacturing variability. This is currently known as a "printer offset". The value of this offset is determined by the user through visual inspection of the position of the labels on the label applicator 202 after the labels are deposited thereon by the label dispenser 250.

As the conveyor shaft 104 rotates, conveyor encoder 106 translates shaft motion into output pulses on A Phase signal 108 generated by the conveyor shaft encoder 106, which represent even increments of motion on the conveyor 100. The turret controller 210 recognizes these pulses and uses them to drive the turret motor 214 in a way that synchronizes the movement of the turret 200 so that the speed at the radius 240 at which the label is applied matches 1 to 1 with the conveyor 100 carrying the items onto which the labels are to be applied.

In addition to maintaining speed with the conveyor 100, turret controller 210 can line up the label depositor arms 202 with the conveyor cups 103 while turning. In order to do this, when starting the turret 200, the turret controller 210 waits until it detects the Index Pulse signal 110 from the conveyor shaft encoder 106 before it starts. Once started the turret controller 210 keeps a count of A Phase pulses 108 and adjusts the position of the turret 200 to match the distance traveled by the conveyor 100. By starting at a specific position of the shaft 104 the position of the turret 200 is consistent relative to the conveyor cups 103. In other words, the Index Pulse signal 110 represents an absolute radial position on the conveyor shaft 104. The relationship between that absolute radial position and a cup position is known. The Turret-at-Home signal 222 represents an absolute radial position of the turret 200. The relationship between the absolute turret position and a label applicator 202 is known. Therefore, proper sequencing between the Index Pulse 110 and the Turret-at-Home signal 222 can keep the label depositor arms 202 in synchronous motion with the cups 103. To ease stress on the turret motor 105 it is accelerated from a stopped position gradually to a speed slightly faster than the conveyor 100 until it has move the same distance traveled by the conveyor 100 and the conveyor cups 103 and turret 200 are in line. At that time the speed is reduced to match the A Phase signal 108.

To adjust for differences between the position of the conveyor cup 103 and the Index Pulse signal from the conveyor shaft encoder 106 an offset is used. This offset, called the "conveyor offset", is added to the target position of the turret motor 105 by the turret controller 210 to change the position of the turret 200 so that when it is synchronized with the conveyor 100 the label applicators 202 line up with the conveyor cups 103. The offset is determined by the operator using visual inspection of where the labels are applied on the objects. The conveyor offset signal is logically grouped as part of the motion control signals 212.

The turret 200 contains multiple flexible label depositor arms 202, typically an even number of arms, such as 8 or 12 located around the circumference of the turret 200. Each flexible label depositor arm 202 has several elements that are crucial to its proper performance and functionality. The flexible label depositor arm 202 is the part of the device that receives the label as it is ejected by the label dispenser 250, and applies the label to the product.

The label dispenser 250, located over the label depositor arm 202, ejects labels on demand with the adhesive side facing up. The turret 200, which is in constant rotational movement synchronized with the conveyor 100 underneath, picks up the ejected labels by means of the multiple flexible label depositor arms 202. Each flexible label depositor arm 202 contains a hollow square shaft, which has a cam follower at one end and a bellow holder at the other end. The cam follower rides on the interior wall of a cam that is designed to extend the square shaft outwards from the center of the turret as it rotates toward the 6 o'clock position. At the other end of the square shaft there is a bellow holder, which holds an extended flexible bellow. At the end of the extended bellow there is a removable boot tip. The boot tip has a center core that is used, both, to attach to the bellow, and to direct positive and negative air to the surface of the boot tip. It is at the surface of the boot tip that the label is received as the label dispenser 250 ejects the label.

As long as the boot tip makes partial contact with the surface of the product it will force itself to follow the product. As the boot tips are in constant contact with the product, these are exposed to foreign substances and bi-products such as wax or bloom located on the surface of the product. These foreign substances and bi-products will be eventually deposited on the surface and air holes of the boot tips. The required grabbing action of the boot tip and the effectiveness of the airflow will be eventually compromised, and they will be required to be cleaned.

As discussed above, sometimes the label applicator system fails to properly adhere to one or more objects. As a result, the unadhered labels remain on the applicator as the same is returned to the label dispenser 250 to pick up another label for application. Thus, it is apparent that an unapplied label remaining on the label applicator 202 as it is returned to the label dispenser will interfere with the proper operation of the label applicator system and can potentially render the same inoperable. Those of skill in the art will appreciate that labels can fail to adhere to an object for any number of reasons. For example, an object can be misaligned, the object can be non-uniform in shape and/or size, and/or the surface of the object may include texture that is not receptive to label adhering. In another example, an object can be missing from a cup 103, and thus no surface is presented to which the label can be adhered. In other scenarios, sometimes a signal is received from a grader to label a product that is not there (i.e., phantom signals). In this situation, a label would be dispensed that will have no product to adhere to. In this instance, the label will have to be removed from the label applicator before returning the label dispenser. In another scenario, the grader operator may make a programming error, and the system attempts to label a product that has dropped from the carriers (cup 103) before reaching the label applicator. Another scenario where the system would need the label pickup roller of the present invention could be where labeling is being performed with an interface that is idle at +24 VDC, and the interface signal drops to 0 VDC (e.g., power to the interface is lost), in this instance, the system will start labeling on every cup regardless if there is product in them or not.

In an embodiment of the present invention, the label applicator system includes a label pickup roller 150 as shown in FIG. 3-6. The label pickup roller 150 is mounted on the label applicator system proximate to and downstream from the label applicators 202 such that the label applicators 202 brush across the label pickup roller 150 after applying (or attempting to apply) a label to an object. Thus, in accordance with an embodiment of the invention, if a label fails to adhere to the object during the labeling run and remains on the label applicator 202, the label is collected by (i.e., adheres to) the label pickup roller 150 before the label applicator returns to the label dispenser 250 to receive another label for dispensing.

Figure 3:
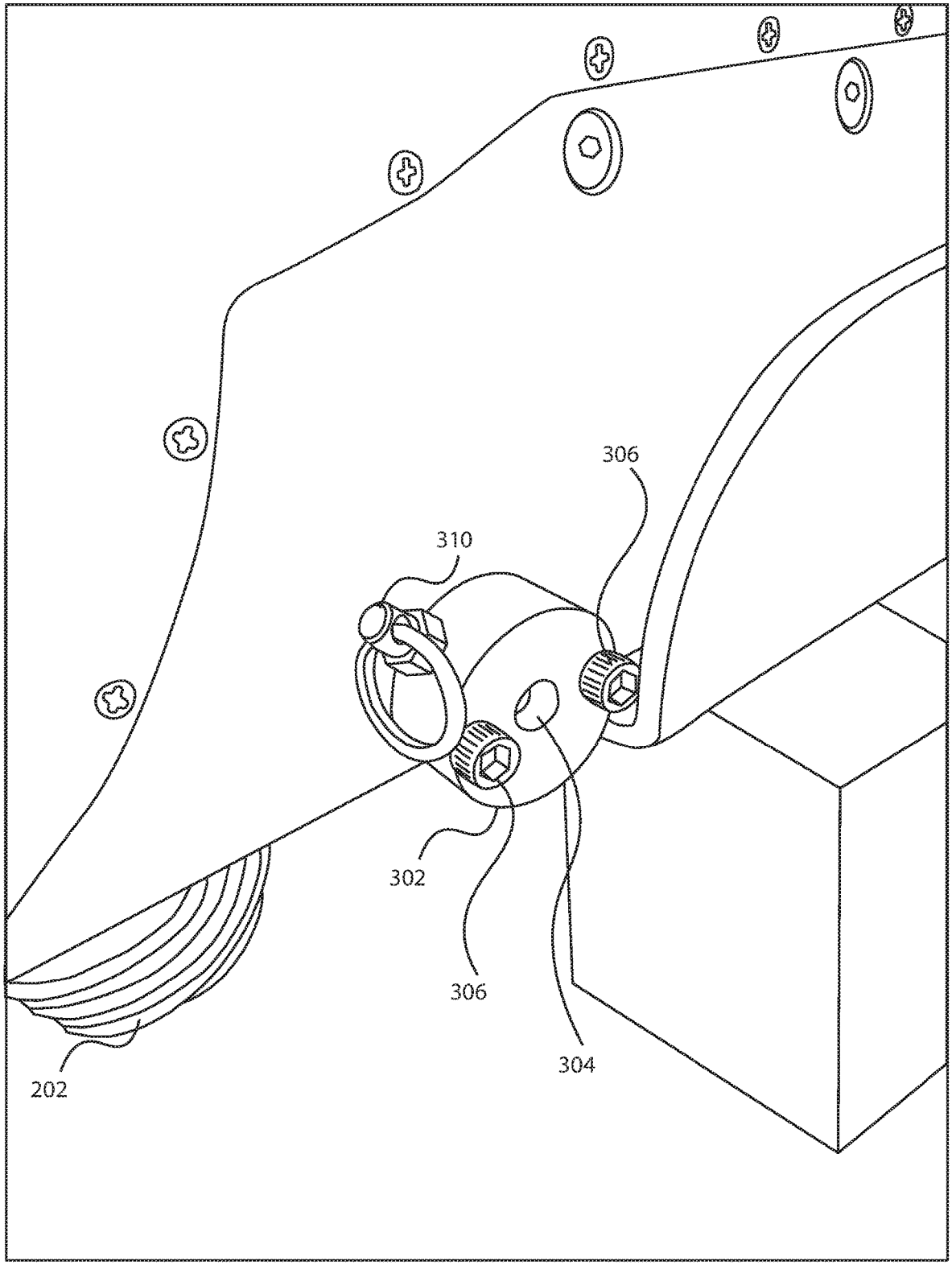
FIG. 3 is a first side view of the high-speed label applicator system incorporating an embodiment of the invention.

FIG. 3 shows a side view of a label applicator system opposite a side of the label applicator system on which the label applicators (bellows) 202 are disposed. This side of the label applicator system is referenced hereinafter as the "exterior side" of the label applicator system for simplicity, while the opposing side is referenced hereinafter as the "interior side" of the label applicator system.

In an embodiment, in order to mount the pickup roller 150 to the label application system, a collar 302 is mounted to a surface of the label applicator system on the exterior side. The collar 302 includes a central bore 304 that extends through the collar 302 to the interior side of the label applicator system via a through hole 402 (FIG. 4) formed on the surface of the label applicator system. The collar 302 is mounted the exterior side of the label applicator system by way of thumbscrews 306 or other affixing devices. Additionally, the collar 302 includes a spring plunger 310 having a plunger portion (not shown) that extends into the central bore 304.

Figure 4:
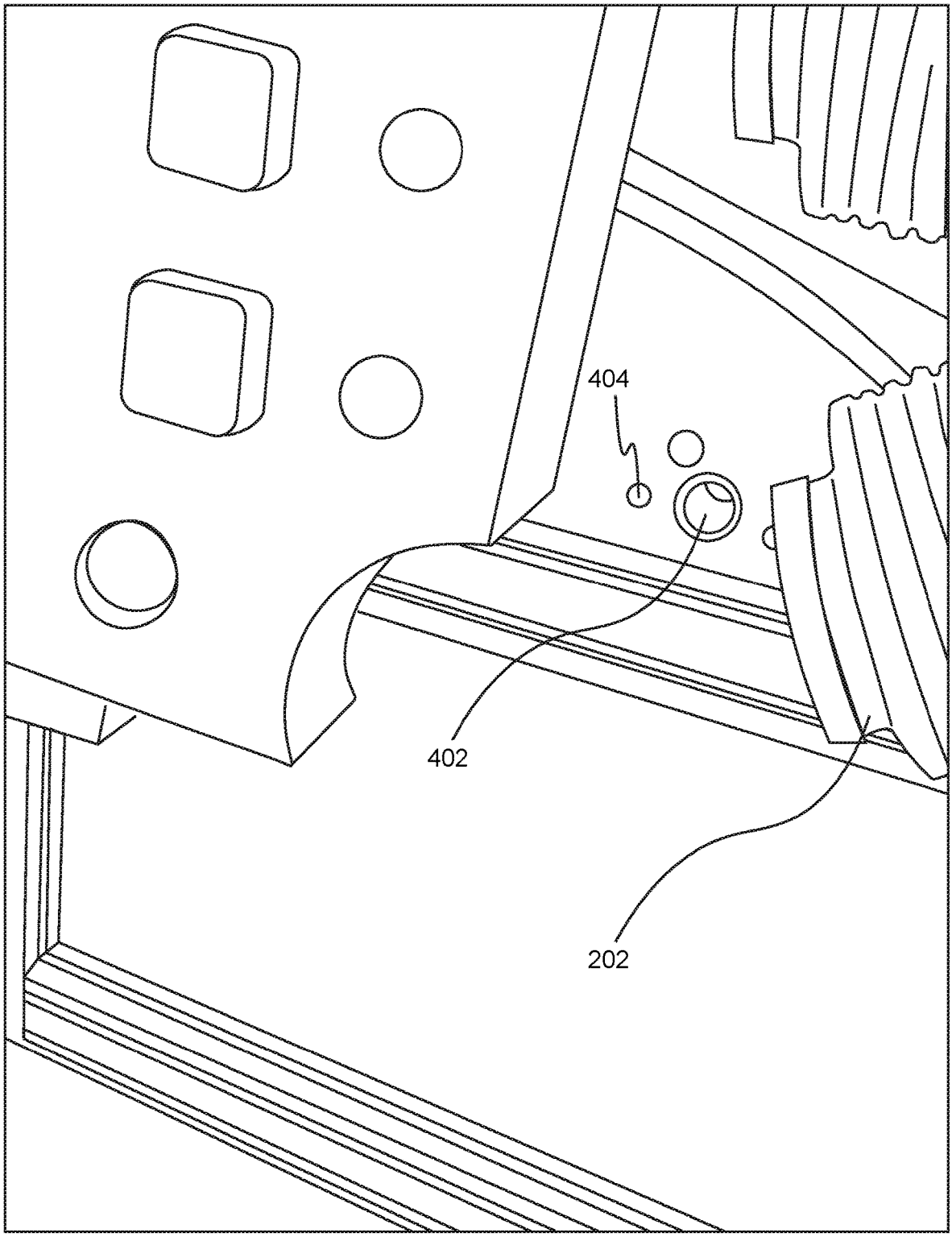
FIG. 4 is an opposing side view of the label applicator system shown in FIG. 3.

Turning to the interior side of the label applicator system, as shown in FIG. 4, Each thumbscrew 306 extends through the collar 302 to insert into a respective screw hole 404. FIG. 4 shows the proximity of the through hole 402, which aligns with the central bore 304 of the collar 302, to the label applicator (bellow) 202.

Figure 5A:
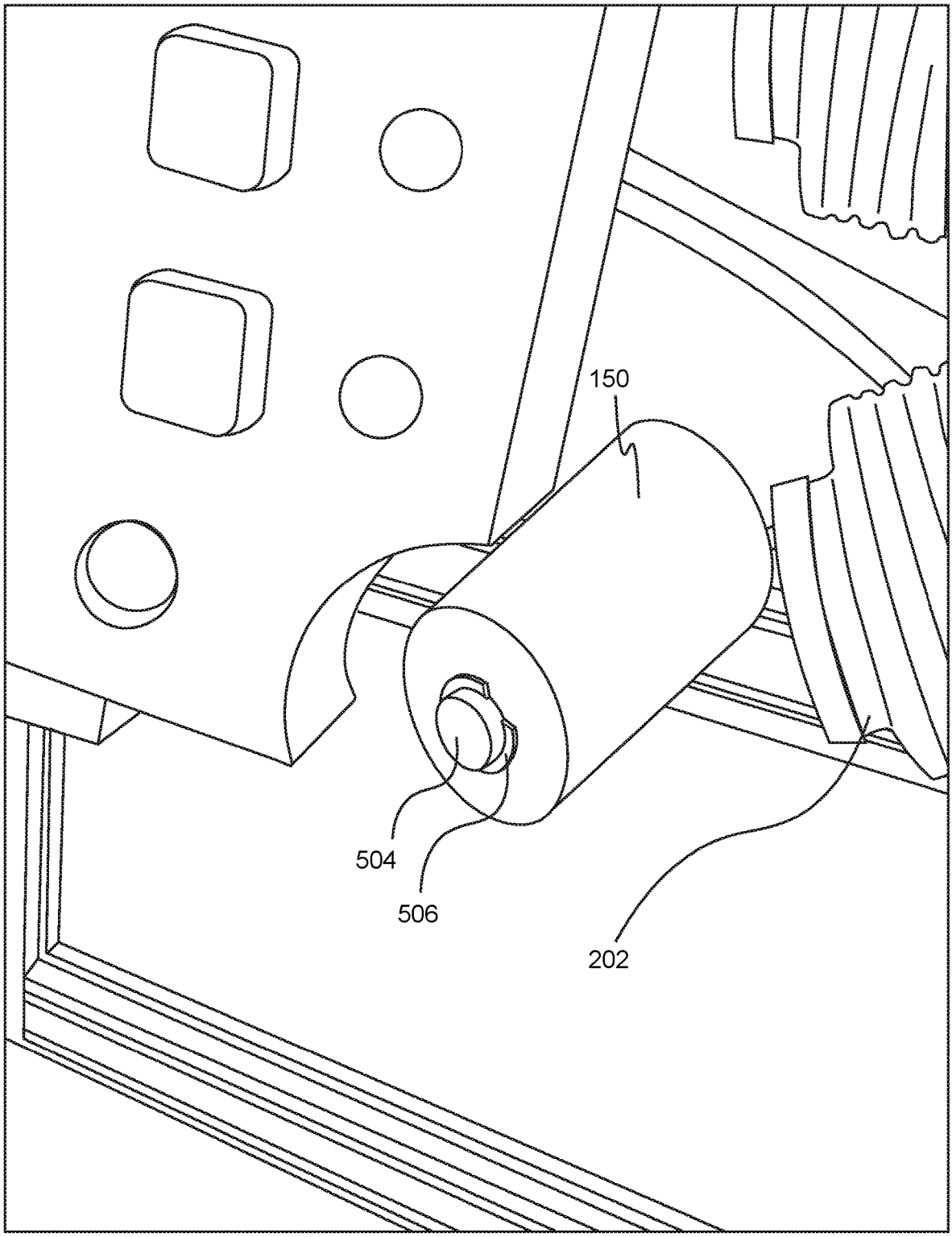
FIG. 5A is the side view of FIG. 4 showing the label pickup roller implemented into the label applicator system according to an embodiment of the invention.
Figure 5B:
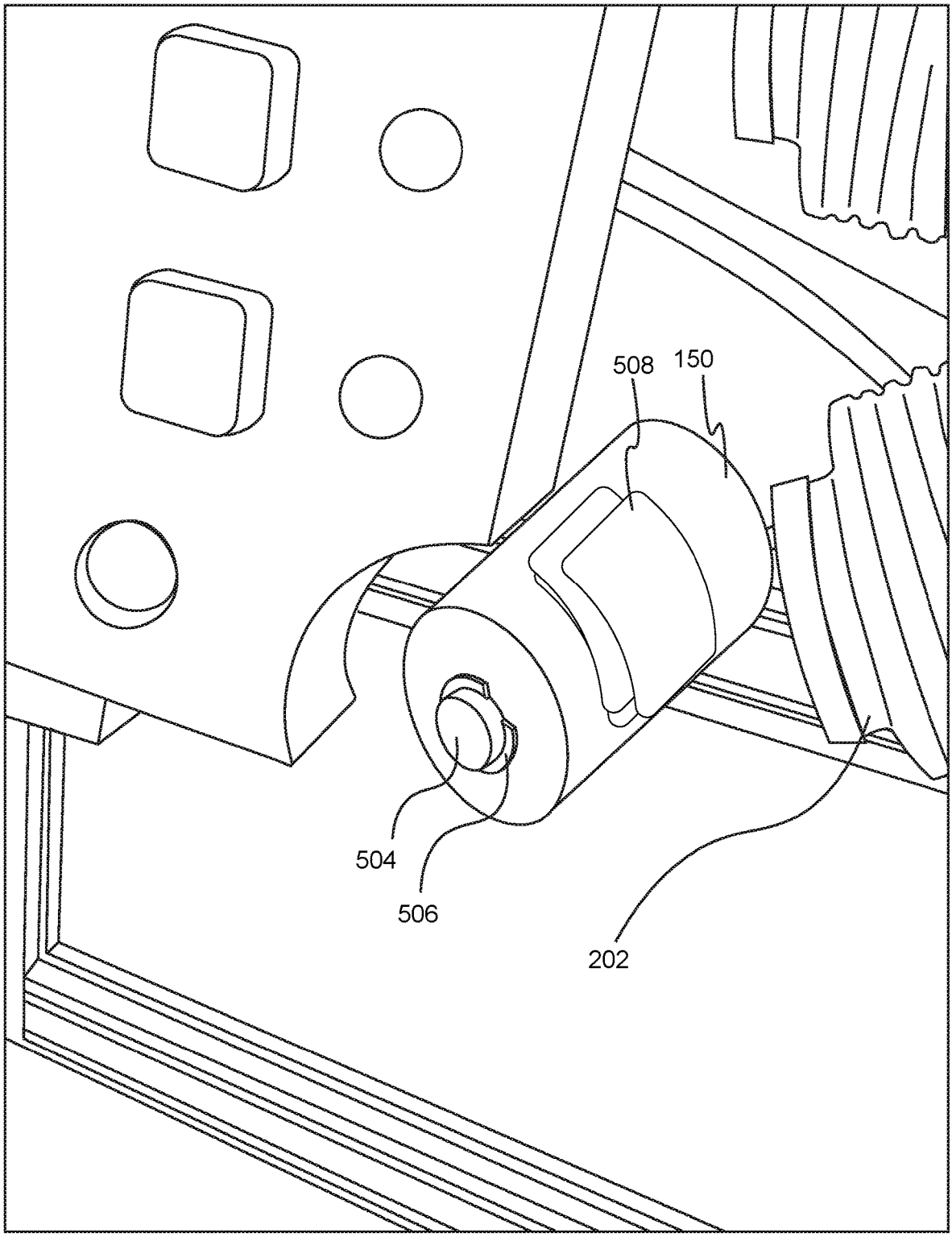
FIG. 5B is the side view of FIG. 4 showing the label pickup roller implemented into the label applicator system according to an embodiment of the present invention.

Turning to FIG. 5A, the interior side of the label applicator system is shown with a label pickup roller 150 installed. The label pickup roller 150 is mounted on a spindle 504 which forms the central rotational axis of the label backup roller 150. As shown in FIG. 5, the label pickup roller has a generally cylindrical shape. The spindle 504 extends beyond the label pickup roller 150 through the through hole 402 and into the central bore 304 of the collar 302. FIG. 5B shows the embodiment of FIG. 5A in operation. The label pickup roller 150 is shown with multiple labels 508 adhered to the surface. In some embodiments, the labels can, at intervals, be removed from the label pickup roller 150 manually. In other embodiments, the label pickup roller 150 can be replaced by removing the retainer 506 and sliding the label pickup roller off the spindle 504. A new label pickup roller can then be inserted onto the spindle 504 and the retainer 506 reapplied to lock the label pickup roller 150 in place.

Figure 6:
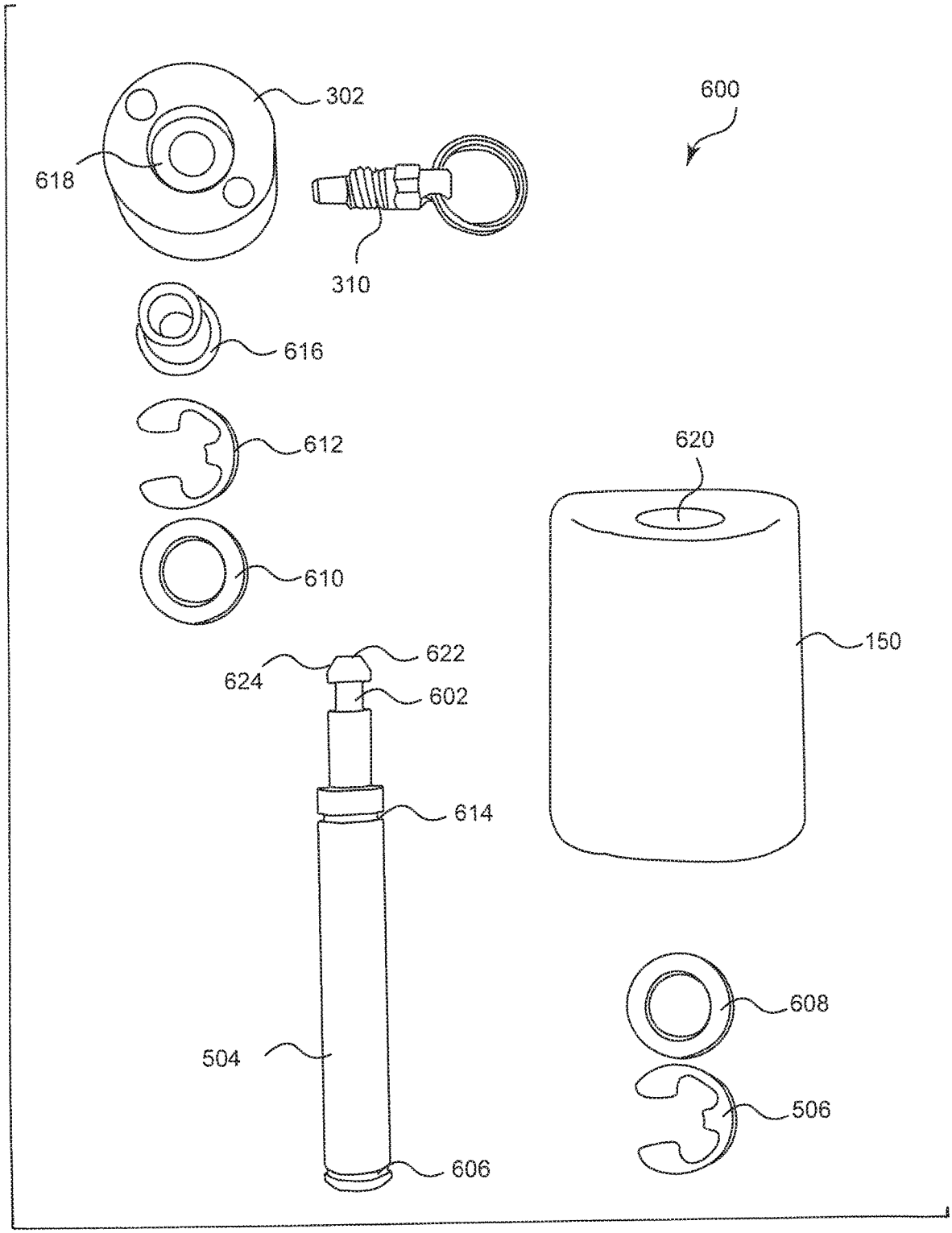
FIG. 6 is an exploded view of one embodiment of the label pickup roller according to an embodiment of the invention.

As shown in FIG. 6, the spindle includes a recess region 602 dimensioned to receive a contact surface of the plunger portion 604 of the spring plunger 310. Thus, the spring plunger 310 holds the spindle laterally in place while allowing the spindle 504 to rotate about its long axis. In other embodiments, the spring plunger 310 can be replaced by a threaded pin or other holding device that allows rotational motion of the spindle while preventing lateral motion.

On the interior side of the label applicator system, the label pickup roller 150 is held in place on the spindle 504 by a retainer 506, such as an E-style retaining ring, for example. Additionally, washers may be positioned between the retainer 506 and the label pickup roller 150. In some embodiments, the retainer 506 can be a nut that screws onto a threaded end of the spindle 504. The label pickup roller 150 can be fabricated from materials that exhibit strong adhesion to labels. For example, a foam material having an affinity for adhesive on labels applied by the label applicator. Examples of such foam material could be reticulated polyester/polyether urethane foam, closed cell polyethylene foam, open cell polyurethane foam, etc.

In FIGS. 5A and 5B the spacing between the label pickup roller 150 and the label applicator 202 are exaggerated to allow for clear visualization of the label pickup roller 150. However, in actuality, the label applicator 202 contacts a surface of the label pickup roller 150 during normal operation of the label applicator system.

FIG. 6 illustrates the components of the label pickup roller assembly 600. The label pickup roller assembly 600 includes a collar 302 having a spring plunger 310 and a bushing 616. The bushing 616 is dimensioned to fit into the opening 402 (shown in FIG. 4) and is seated in recess 618 of the collar 302. In some embodiments, the label applicator system may need to be modified to accept the label pickup assembly 600. Such modifications can include drilling any necessary holes such as the opening 402 and one or more screw holes 404, for example.

The pickup roller 150 is assembled by seating a first E-style retaining ring 506 into the first retainer recess 606 of the spindle 504. Once the retaining ring 506 is seated properly, a first washer 1508 is mated to the spindle 504. Next, the spindle 504 is inserted into a central opening 620 of the label pickup roller 150. At this point, the label pickup roller 150 is mounted on the spindle 504 and abuts the first washer 608 that is positioned between the label pickup roller 150 and the first retaining ring 506.

Following mounting of the label pickup roller 150 onto the spindle 504, a second washer 610 can be mounted onto the shaft of the spindle 504, such that the second washer 610 abuts an opposite side of the label pickup roller 150 than the first washer 608. A second E-style retaining ring 612 is seated at the second retainer recess 614. At this point the label pickup roller 150 is locked in place on the spindle 504. The label pickup roller assembly 600 is completed by sliding the spindle 504 through the bushing 616 until the recess region 602 aligns with a plunger portion 604 of the spring plunger 310 seated in on the collar 302.

As the spindle is inserted into the collar 302, the plunger portion 1504 of the spring plunger 310 may need to be retracted to allow the recess region 602 to properly align with the plunger portion 604. In some embodiments the insertion end 622 of the spindle 504 can include bevels 624 configured to lift the plunger portion 604 as the spindle 504 is inserted into the collar 302. The plunger portion 604 is pressed into the recess region 602 by action of a spring (not shown) housed in the body of the spring plunger 310 when the plunger portion 604 is aligned with the recess region 602.

For illustrative purposes only, the assembly of the label pickup roller assembly 150 is described herein using a particular order of steps. However, in practice, not only can the label pickup roller assembly 600 can be assembled in any appropriate order without departing from the present invention, but other methods for rotatably securing the spindle 504 to the machine can also be implemented without departing from the intended scope and spirit of the invention. Additionally, while embodiments are described with respect to label applicator systems, some embodiments can be applied to other types of commercial label printers as well.

Figure 7A:
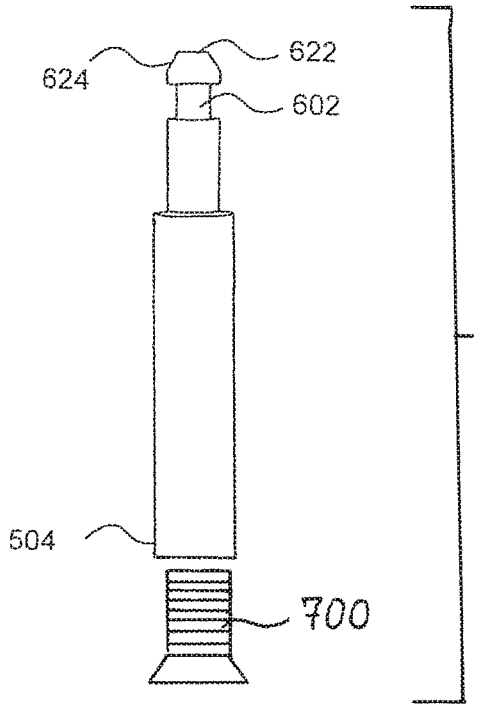
FIG. 7A is a schematic view of another embodiment of the label pickup roller spindle assembly according to an embodiment of the invention.

FIG. 7A shows yet another embodiment where the spindle 504 is internally threaded (not shown) and is configured to receive a screw 700. In this embodiment, the spindle 504 is inserted through the central opening 620 of roller 150 and screw 700 would secure the roller onto the same. Once the roller 150 is connected to the spindle 504, it can be attached to the machine in any known manner, including that described above with respect to FIG. 6. In this embodiment, the internal threads and mating threads of screw 700 threads are configured such that they are opposite the rotation direction of the roller 150. In this manner, the roller 150 will not come loose during rotation/operation.

Figure 7B:
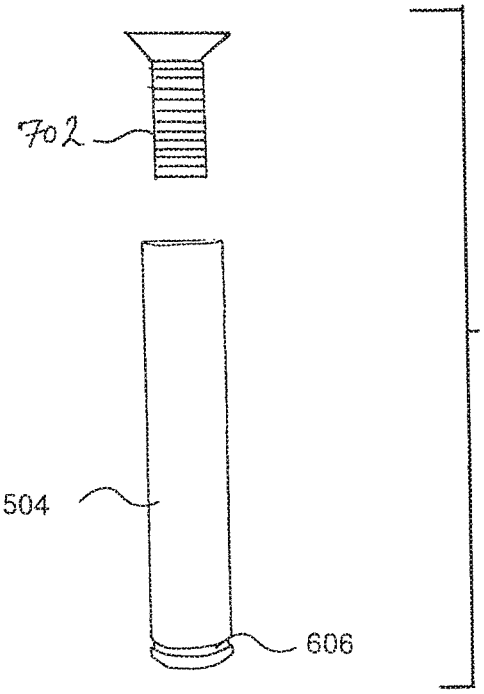
FIG. 7B is a schematic view of a further embodiment of the label pickup roller spindle assembly according to an embodiment of the invention.

FIG. 7B shows yet another embodiment where the spindle 504 is connected to the labeling machine using the screw 704 passing through hole 403 (See FIG. 4) and received by a corresponding internal threading (not shown) in the spindle 504. In this manner, the spindle is screwed into the machine, and the roller 150 can be attached to the spindle 504 as described above with respect to FIG. 6. In other contemplated embodiments, the outer portion of spindle 504 can be rotatable with respect to its central axis such that the roller 150 could be attached to the spindle 150 using screw 702 as shown in FIG. 7A, and the spindle 504 can be attached to the machine using the screw 702 shown in FIG. 7B. Those of skill in the art will appreciate that there are many ways to secure roller 150 to the spindle such the same rotates with the operation of the machine, whether it be the spindle or the roller that includes the "rotatable" portion.

While there have been shown, described and pointed out fundamental novel features of the present principles, it will be understood that various omissions, substitutions and changes in the form and details of the methods described and devices illustrated, and in their operation, may be made by those skilled in the art without departing from the spirit of the same. For example, it is expressly intended that all combinations of those elements and/or method steps which perform substantially the same function in substantially the same way to achieve the same results are within the scope of the present principles. Moreover, it should be recognized that structures and/or elements and/or method steps shown and/or described in connection with any disclosed form or implementation of the present principles may be incorporated in any other disclosed, described or suggested form or implementation as a general matter of design choice. It is the intention, therefore, to be limited only as indicated by the scope of the claims appended hereto.

What is claimed is:

1. A device for removing unattached labels from a label applicator in a label applicator system having a label dispenser and the label applicator, the device comprising:

a spindle mounted to a side of the label applicator system proximate to a rotational path of the label applicator and downstream from a label application point of an object to be labeled by the label applicator system, the spindle having an axis of rotation; and a label pickup roller positioned on the spindle such that the label applicator contacts the label pickup roller before returning to the label dispenser.

2. The device of claim 1, wherein the label pickup roller is positioned to contact the label applicator at a point along the rotational path of the label applicator.

3. The device of claim 2, wherein the label pickup roller is configured to remove labels from the label applicator that failed to adhere to the object to be labeled by the label applicator.

4. The device of claim 1, further comprising:

a collar mounted on a first side of the label applicator system, the collar having a central bore dimensioned to accept insertion of the spindle; and a spring plunger disposed on the collar and positioned to securely engage with the spindle.

5. The device of claim 4, wherein the spindle is inserted into the collar from a second side of the label applicator system through an opening formed on a surface of the label applicator system and aligned with the central bore of the collar.

6. The device of claim 4, wherein the spring plunger limits lateral motion and allows rotational motion of the spindle.

7. The device of claim 4, wherein the spindle includes a recess region configured to engage with a plunger portion of the spring plunger.

8. The device of claim 7, wherein the spindle includes a beveled surface forward of the recess region, the beveled surface configured to lift the plunger portion of the spring plunger during insertion of the spindle into the central bore of the collar prior to engagement of the recess region with the plunger portion.

9. The device of claim 1, further comprising retaining rings coupled to the spindle at respective first and second sides of the label pickup roller, the retaining rings limiting lateral motion of the label pickup roller along the spindle.

10. The device of claim 1, wherein the spindle is mounted to the label applicator machine using a threaded type engagement.

11. The device of claim 1, wherein the spindle further includes threads, and the roller is configured with internal threads such that the roller is threadably secured to the spindle.

* * * * *